US005737893A

United States Patent [19]

Rossiter et al.

[11] Patent Number: 5,737,893

[45] Date of Patent: Apr. 14, 1998

[54] PANEL CONSTRUCTION AND CONNECTION SYSTEM

[75] Inventors: Paul Rossiter, Carleton Place; Steven Jones, Nepean, both of Canada; Andrew Schoenherr, Milpitas, Calif.

[73] Assignee: Tetrad Marketing/Sales Ltd., Ontario, Canada

[21] Appl. No.: 735,642

[22] Filed: Oct. 23, 1996

[30] Foreign Application Priority Data

Oct. 26, 1995 [CA] Canada ..... 2161459

[51] Int. Cl.[6] ..... E04C 2/34

[52] U.S. Cl. ..... 52/481.2; 52/239; 160/371; 160/381; 160/351

[58] Field of Search ..... 52/762, 239, 238.1, 52/241, 242, 481.2, 144, 145, 222, 656.9, 800.11, 800.12, 800.18; 160/135, 351, 371, 392, 395, 381

[56] References Cited

U.S. PATENT DOCUMENTS

| | | | |
|---|---|---|---|
| 3,480,313 | 11/1969 | Halko, Sr. | 52/646.9 X |
| 3,768,222 | 10/1973 | Birum . | |
| 4,104,838 | 8/1978 | Hage et al. . | |
| 4,147,198 | 4/1979 | Ytter . | |
| 4,690,192 | 9/1987 | Stilling | 160/395 X |
| 4,761,922 | 8/1988 | Black . | |
| 4,891,922 | 1/1990 | Hozer et al. . | |
| 5,054,255 | 10/1991 | Maninfior . | |
| 5,067,543 | 11/1991 | Bove . | |
| 5,070,666 | 12/1991 | Looman . | |
| 5,125,193 | 6/1992 | Beaulieu . | |
| 5,274,975 | 1/1994 | Haag | 52/239 X |
| 5,394,658 | 3/1995 | Schreiner et al. | 52/239 X |

FOREIGN PATENT DOCUMENTS

| | | | |
|---|---|---|---|
| 1058372 | 7/1979 | Canada . | |
| 2017666 | 12/1990 | Canada . | |
| 2090386 | 8/1994 | Canada . | |
| 2027194 | 12/1971 | Germany | 56/656.9 |
| 2161193 | 1/1986 | United Kingdom | 160/381 |

*Primary Examiner*—Creighton Smith

*Attorney, Agent, or Firm*—Killworth, Gottman, Hagan & Schaeff, L.L.P.

[57] ABSTRACT

A light weight, upholstered panel for use in modular and free standing office landscaping systems. The panels form free standing partitions which can be rearranged and assembled into an office system. Panels can be interconnected and positioned over a range of angles relative to adjacent panels. The panel core is composed of a light weight composite structural material with perimeter frame members along each edge. Each frame member has the same cross-section along its length. The horizontal perimeter horizontal frame members are inter-connected with the vertical frame members by corner connectors. The corner connectors have protrusions which engage hollow cavities in the ends of the frame members. The perimeter frame acts to transfer loads imposed on the panel to the structural core. The perimeter frame members incorporate formations to secure the panel fabric, trim and the inter-panel connection system in place and provide recesses for fasteners and support hardware.

20 Claims, 16 Drawing Sheets

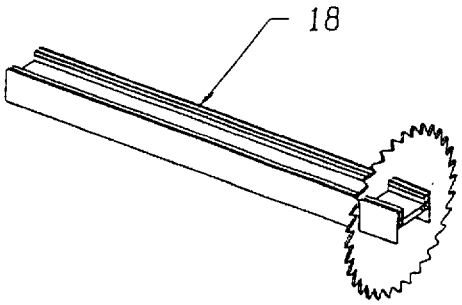
Figure 6A
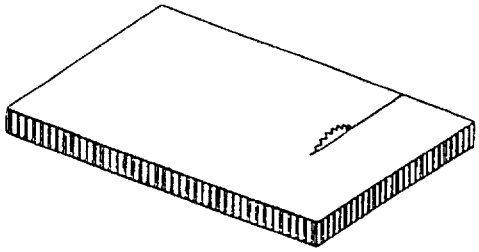
Figure 6B
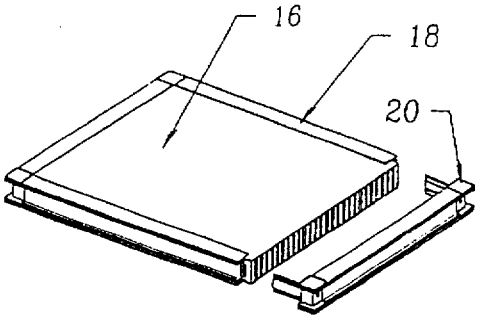
Figure 6C
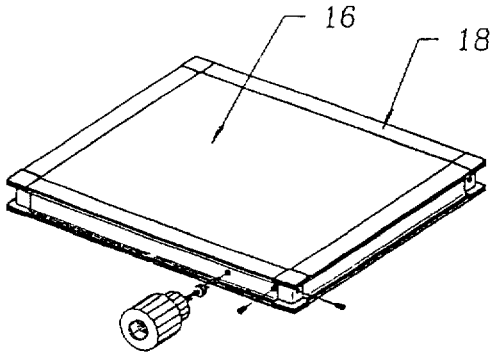
Figure 6D
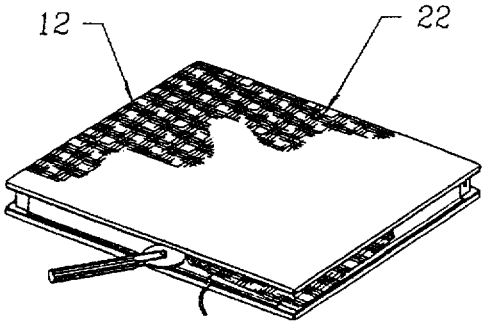
Figure 6E
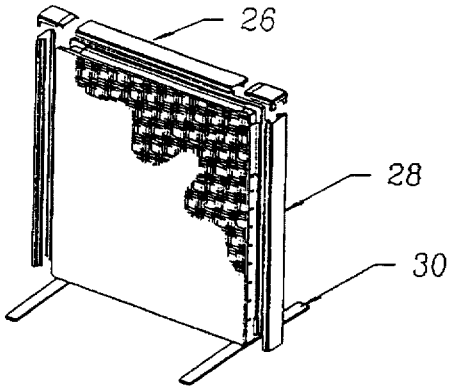
Figure 6F
Figure 6

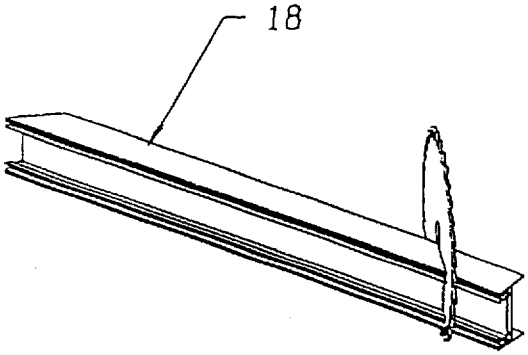
Figure 9A
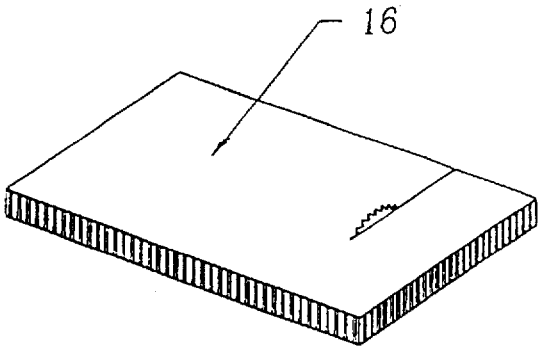
Figure 9B
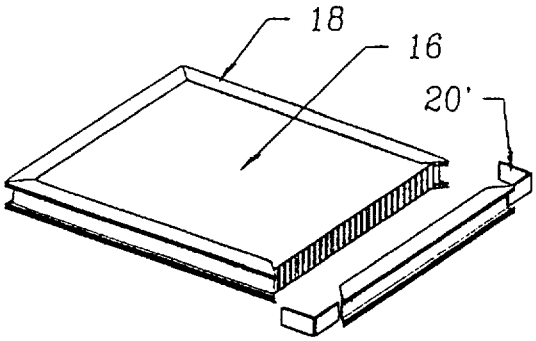
Figure 9C
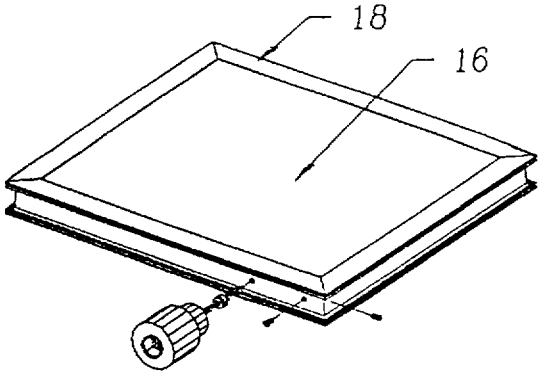
Figure 9D
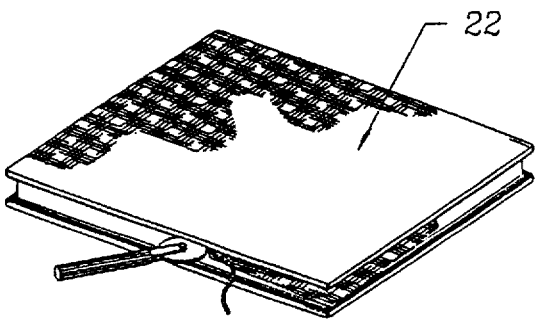
Figure 9E
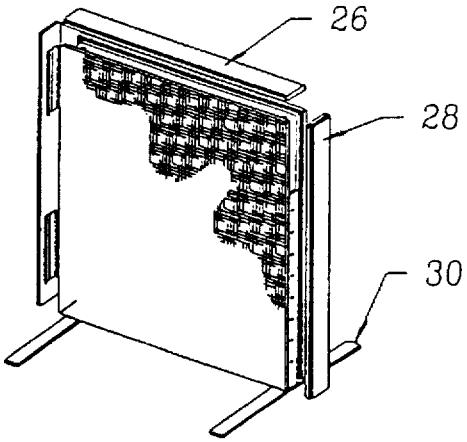
Figure 9F
Figure 9

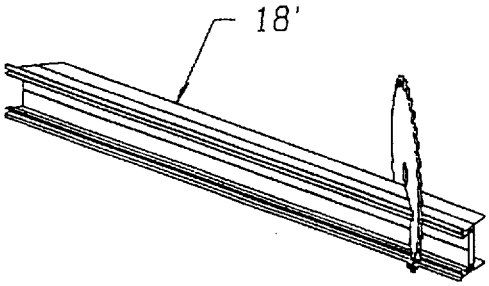
Figure 11A
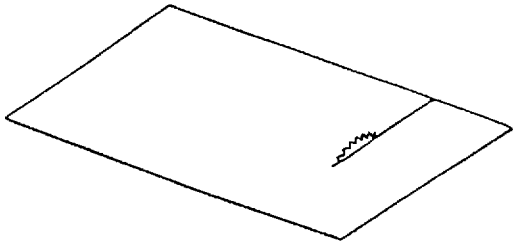
Figure 11B
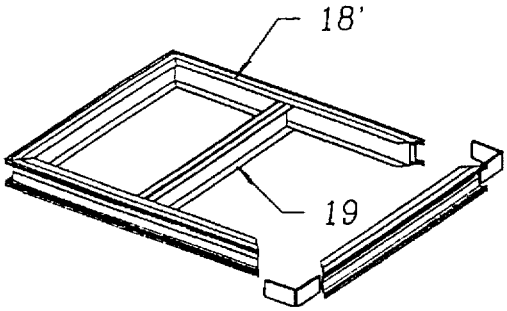
Figure 11C
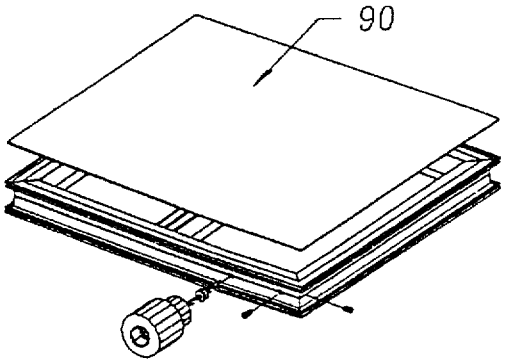
Figure 11D
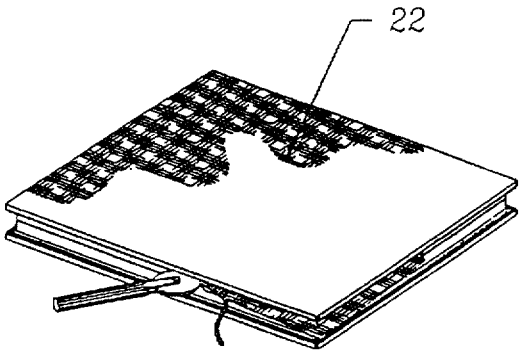
Figure 11E
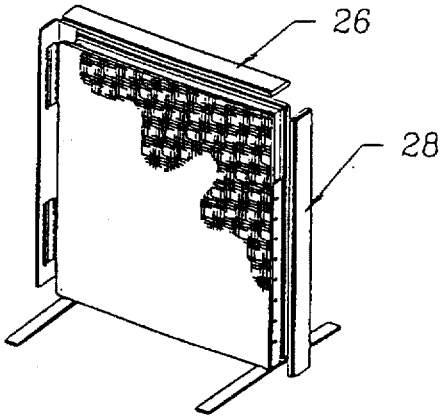
Figure 11F
Figure 11

PANEL CONSTRUCTION AND CONNECTION SYSTEM

BACKGROUND OF THE INVENTION

This invention relates to simple light weight panel constructions, frame assemblies having connections to secure components to the perimeter frame and means to configure said panels in various arrangements in an office landscape.

Modern office landscaping systems, be they free standing or modular, typically comprise a panel with a structural time enclosing a core. In these constructions, all loads are resolved within the frame which consists typically of wood or metal encasing a core usually having acoustic absorption properties. In larger panels, the frame may require substantial cross-bracing to maintain panel rigidity. This construction adds weight and reduces space for core material, thus reducing performance if the core material is acoustical in nature.

Panel frames are typically made from wood or steel. Wood frame components require substantial processing before they can be assembled into panel frames. In both cases the resultant panel is of considerable weight, and this imposes extra requirements and costs on the design of related components. This increased weight also increases the complexity of the system since heavy panels require strong fastening systems to hold them in place. The high weight and complex fastening systems also increase the difficulty in assembling and configuring the system.

The panels usually are constructed with flat or curved cores surrounded by a perimeter frame. Typically, the panels are assembled and interconnected in an edge to edge relationship to form an office workspace environment with combinations of continuous walls and corner joints. Common connection systems, where a vertical edge is constructed with a male connection frame member which engages a vertical female frame member along the longitudinal axis on the adjacent edge are limited to configurations with standard panel sizes and set angles as disclosed for example by U.S. Pat. No. 5,054,255 and Can. Pat. Nos. 2,090,386. A significant drawback to this type of panel connection system is that panels must always be disposed in a similar manner thus limiting the flexibility of the system and any reconfiguration thereof.

In further typical office systems, changes in directions require the addition of transition posts to effect the angle change. While these posts offer limited flexibility, each variation of post must be fabricated, inventoried, and stored thus requiring extensive labour and cost to reconfigure such systems, reference being had to U.S. Pat. No. 4,101,838.

As noted above, most panels are constructed with a perimeter frame around the acoustic core. Typically the frame members are inter connected through means of a corner connector. These corner connections tend to be permanent and do not enable disassembly without damaging the adjacent frame members. This results from the corner connector having barbs which "lock" in the hollow cavities into which they are inserted. Examples of this type of component are disclosed by U.S. Pat. No. 5,054,255. The penalty for this type of construction is that it limits re-sizing of the panels during reconfiguration of the system.

SUMMARY OF INVENTION

Basic objectives of the invention are to alleviate the disadvantages of the prior art systems noted above by providing a partition panel and associated components as described hereafter.

According to the invention, in one aspect, there is provided a partition panel including a generally rectangular core having opposed major faces and a perimeter frame assembly encompassing said core, said perimeter frame assembly comprising a plurality of frame members extending along said marginal edges of the core, and a plurality of corner connectors each located at a respective one of the corners of the panel and attaching adjacent ends of said frame members together, said frame members including spaced primary flanges directed generally parallel to said major faces and disposed in flanking relation to edge portions of said core, and said frame members further including a double-walled web extending between said primary flanges and providing a lengthwise extending hollow cavity, each corner connector including a pair of legs each fitting tightly into adjacent ends of the frame members via the associated hollow cavities to secure said frame members together at said corners of the panel.

In one form of the invention said frame members include spaced apart groove defining members each of which is adjacent a respective one of said flanges and adjacent opposing longitudinal margins of said web and the grooves defined thereby being directed outwardly of said panel perimeter, and a flexible covering material overlying the major faces of said core and having marginal edges of said material engaged in said grooves to secure said covering material in said overlying relation to said major faces.

Preferably said groove-defining members are in the form of secondary flanges parallel to said primary flanges, said secondary flanges having retaining means thereon to secure the marginal edges of the covering material therein.

Said retaining means may comprise projections formed on interior or mouth portions of said grooves to provide a re-entrant shape to the latter, said marginal edges of the covering materials having enlargements or beads therealong entrapped in said grooves via said projections.

Said secondary flanges preferably have a shallow U-shape channel therebetween, said channel being defined by said secondary flanges and an outwardly facing wall of said web, said channel also facing outwardly away from the perimeter of the panel, each of said secondary flanges having enlargements along free distal edges thereof, and panel edge trim covers in snap-fitting engagement with said enlargements of the secondary flanges to cover at least one of said perimeter frame members.

As a further feature said corner connector may have formations thereon defining spaced-apart grooves communicating with and generally co-planar with said grooves in said frame members whereby the marginal edges of said covering material may be engaged and held in said grooves all around the perimeter of the panel including its corners.

In one embodiment said corner connector has shoulders thereon which butt-up against the adjacent ends of the perimeter frame members when the legs of the corner connector are fully inserted into said hollow cavities of said frame members, said legs being in a close friction fit within said cavities.

In another embodiment said perimeter frame members and said corner connector have an outstanding perimeter ledge thereon which receive and surround a sheet of rigid material positioned over each of the major faces of the core.

In another embodiment the adjacent ends of the perimeter frame members butt-up against each other, said adjacent ends being angled or bevelled to provide a complementary fit, and said corner connector being fully enclosed by adjacent end portions of the frame members when butted-up against one another in the assembled condition.

Said frame members typically comprise plastics extrusions of uniform cross-section throughout their lengths.

A further aspect of the invention provides a perimeter frame member adapted to be located at the perimeter of a partition panel, said frame member having a spaced apart pair of generally parallel primary flanges and a double-walled web extending between and fixed to said primary flanges generally at right angles thereto to define a primary channel along one wall of said web and said double-walled web providing a lengthwise-extending hollow cavity adapted to receive a leg of a corner connector for joining adjacent said frame members together; and a spaced apart pair of groove defining elements extending along opposing longitudinal marginal portions of said web with each being adjacent a respective one of said primary flanges but disposed on that wall of the web opposite said one wall, said groove defining elements including of secondary flanges generally parallel to said primary flanges, said secondary flanges having retaining means thereon to assist in securing a marginal edge of a panel covering material therein.

The retaining means typically comprises projections formed on said secondary flanges and directed into interior or mouth portions of said grooves to provide a re-entrant shape to the latter for retention of a marginal edge portion of a covering material.

The secondary flanges preferably have a shallow U-shape secondary channel therebetween, said secondary channel being defined by said secondary flanges and said opposite wall of said web, said secondary flanges having enlargements inwardly directed toward each other along free distal edges thereof adapted to secure a panel edge trim cover in snap-fitting engagement with the perimeter frame member.

The perimeter frame member is preferably an extrusion of plastics material.

A partition panel according to another aspect of the invention is of generally rectangular outline having opposed major faces and a perimeter frame assembly comprising a plurality of frame members extending along marginal edges of the panel, and a plurality of corner connectors each located at a respective one of the corners of the panel and attaching adjacent ends of said frame members together, said frame members including spaced primary flanges directed generally parallel to said major faces, said frame members further including a double-walled web extending between said primary flanges and providing a lengthwise extending hollow cavity, each corner connector including a pair of legs each fitting tightly into adjacent ends of the frame members via the associated hollow cavities to secure said frame members together at said corners of the panel.

In this embodiment said perimeter frame members and said corner connector preferably have outstanding perimeter ledges on opposing sides thereof which receive and surround respective sheets of rigid material positioned to define each of the major faces of the panel. The previously noted centre core of acoustic material may be omitted.

Other features of the partition panel are described and claimed hereinafter.

A further feature of the invention provides a panel-to-panel connector for use with panels having horizontal frame members which provide a spaced pair of parallel flanges defining a channel and said flanges having protrusions thereon directed inwardly toward each other; said connector including a pair of members pivotally connected together, each said member including at least one retainer chip adapted to be snap-fitted into engagement with the protrusions of said flanges forming the channel of the associated panel frame member, said retainer clips also being slidably adjustable along their associated channels to permit a variety of angular orientations of the panels being connected relative to one another.

Preferably each said member includes an elongated tongue with said retainer clips being formed at distal end portions of the respective tongues and said tongues being pivotally connected together at a point spaced from said retainer clips.

Each retainer clip may comprise a shallow channel formation defined by a spaced apart pair of walls on opposing sides of said distal end portion of the tongue, said walls each having a projection therein adapted to complement and come into said snap-fit engagement with the protrusions on the flanges of the panel frame members.

The foregoing and other advantages of the invention will be discussed in the following specification and claims, combined with reference to the appended drawings.

BRIEF DESCRIPTION OF THE VIEWS OF DRAWINGS

FIGS. 6A–6F illustrate the steps involved in the manufacture and assembly of one embodiment of the partition panel;

FIGS. 9A–9F show steps involved in the manufacture and assembly of the partition panel when utilizing the corner connector of FIGS. 7 and 8;

FIGS. 11A–11F illustrate steps in the manufacture and assembly of a partition panel utilizing the modified perimeter frame members illustrated in FIG. 10;

Figure 16:
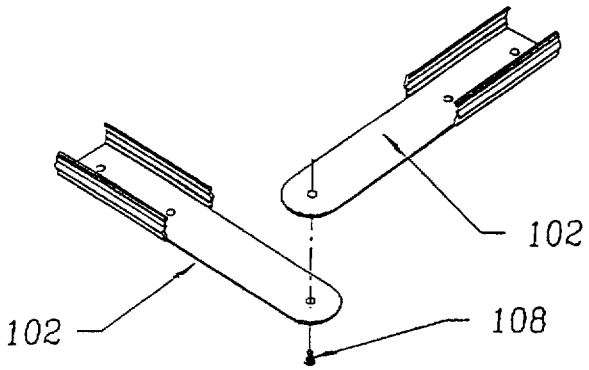
FIGS. 16, 17 and 18 show slightly modified forms of panel connectors, i.e. two-way, three-way and four-way connectors respectively.
Figure 17:
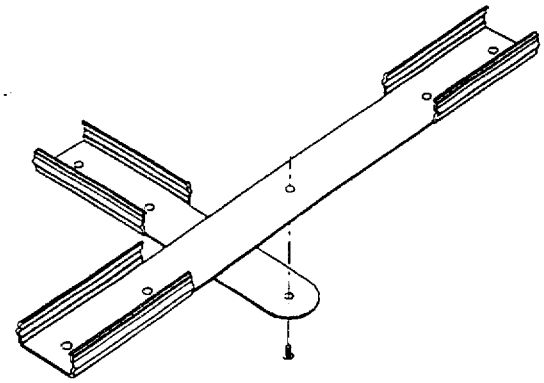
Figure 18:
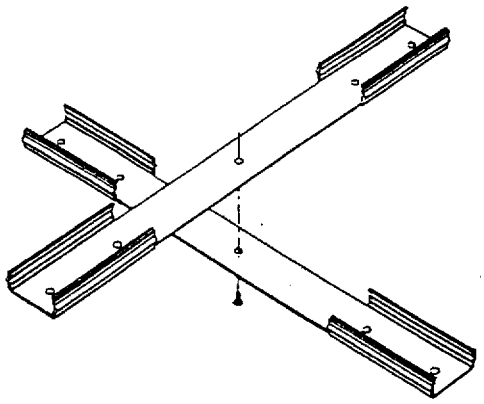
Figure 19A:
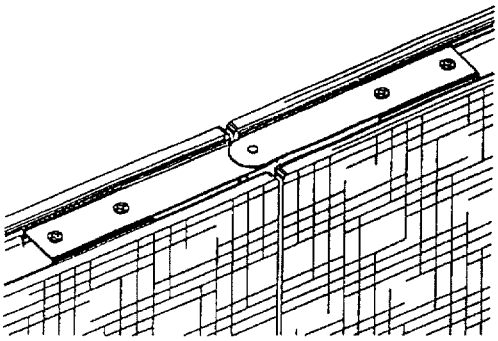
Figure 19B:
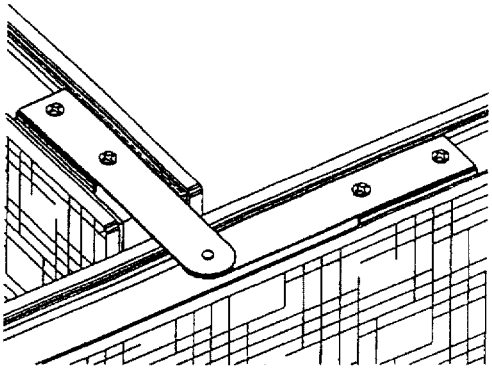
Figure 19C:
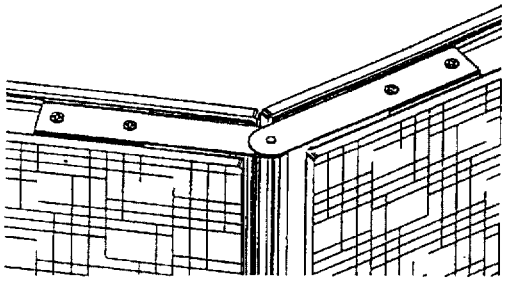
Figure 20:
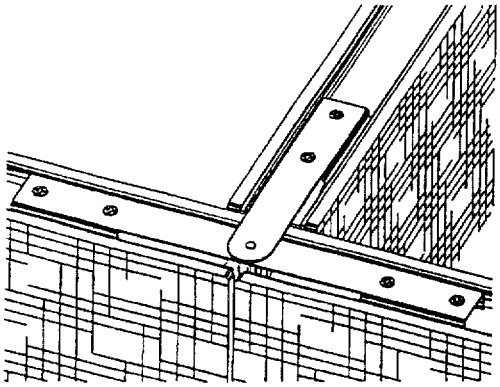
Figure 21:
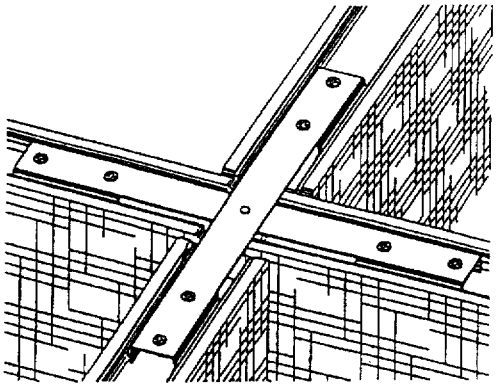

FIGS. 19A, B and C show various ways of utilizing the two-way connector shown in FIG. 16;

FIGS. 20 and 21 show ways of using the three-way and four-way connectors of FIGS. 17 and 18 respectively.

DETAILED DESCRIPTION OF PREFERRED EMBODIMENTS

Figure 1:
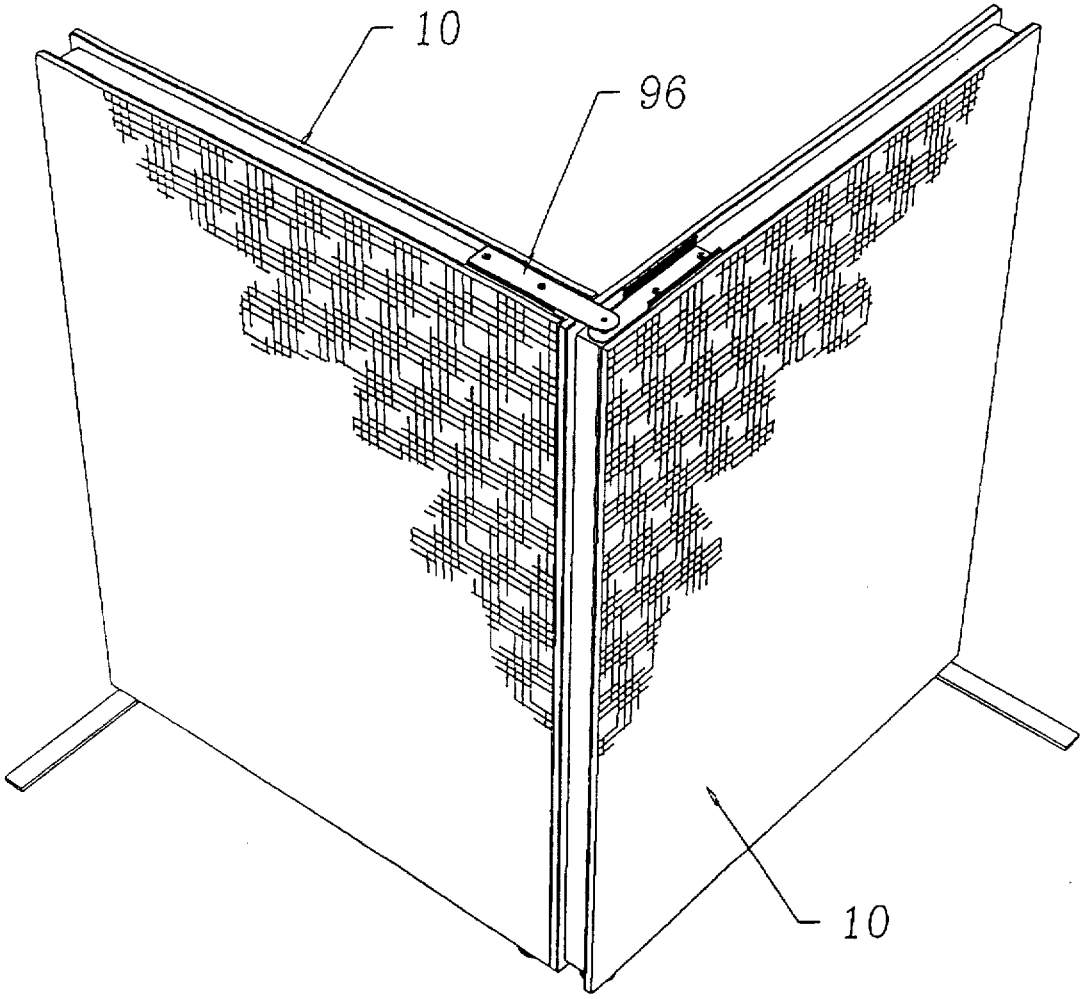
FIG. 1 is a perspective view showing two lightweight panels disposed in close relation and configured to form a partition corner.

With reference to FIG. 1 there is shown an office partition comprising a pair of panels 10 constructed in accordance with the present invention and arranged in an edge-to-edge transverse manner and connected together by means of a panel connecting device 96 to be described hereinafter.

With reference to FIGS. 2–5, each of the panels 10 is constructed utilizing a perimeter frame assembly 14 which encompasses the perimeter of a composite structural core 16 which is shown as being of rectangular outline shape. The perimeter frame assembly 14 comprises a plurality of frame members 18*a*, 18*b*, 18*c* and 18*d* extending along each of the four marginal edges of the core 16. A plurality of corner connectors 20 are provided, each located at a respective one of the corners of the assembly 14 and attaching adjacent ends of the frame members 18 together. The exterior major faces of the panel assembly 12 are covered with suitable covering materials, e.g. an exterior flexible covering fabric 22 and an underlying layer of thin foam 24. Top and side edge grim covers 26, 28 respectively extend along and cover up the peripheral edges of the panel assembly to provide a finished panel appearance compatible with modern office decor.

Figure 2:
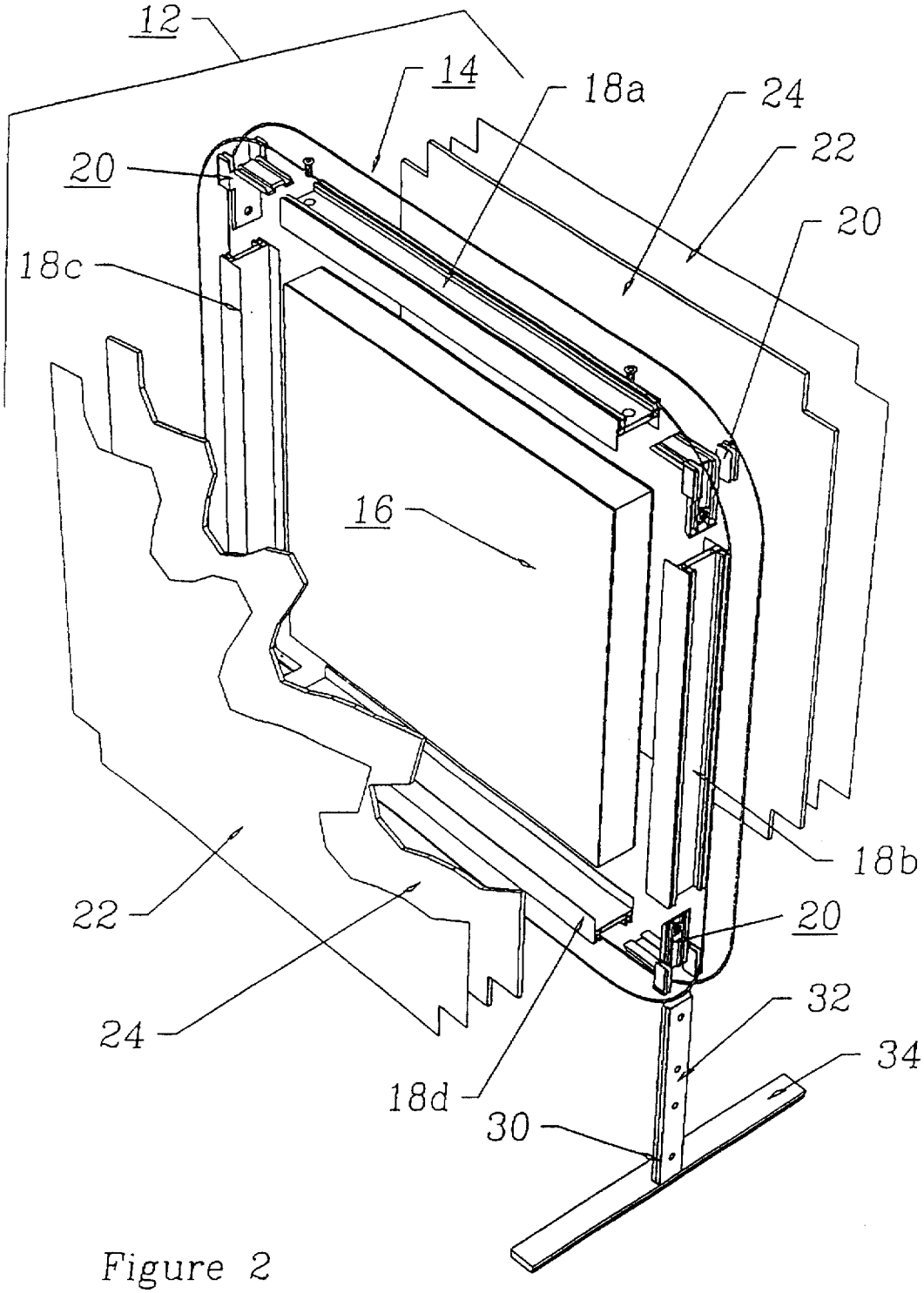
FIG. 2 is an exploded view of a panel in accordance with one embodiment of the invention.

With reference to FIG. 2, feet members 30 are attached to the panel assembly by way of the vertical perimeter frame members 18*b*, 18*c* at the opposing ends of the panel assembly by means of fasteners (not shown) which extend through suitable apertures provided in the vertical legs 32 of the feet members. The transverse feet 34 of members 30 bear directly against the floor in well known manner.

Figure 3:
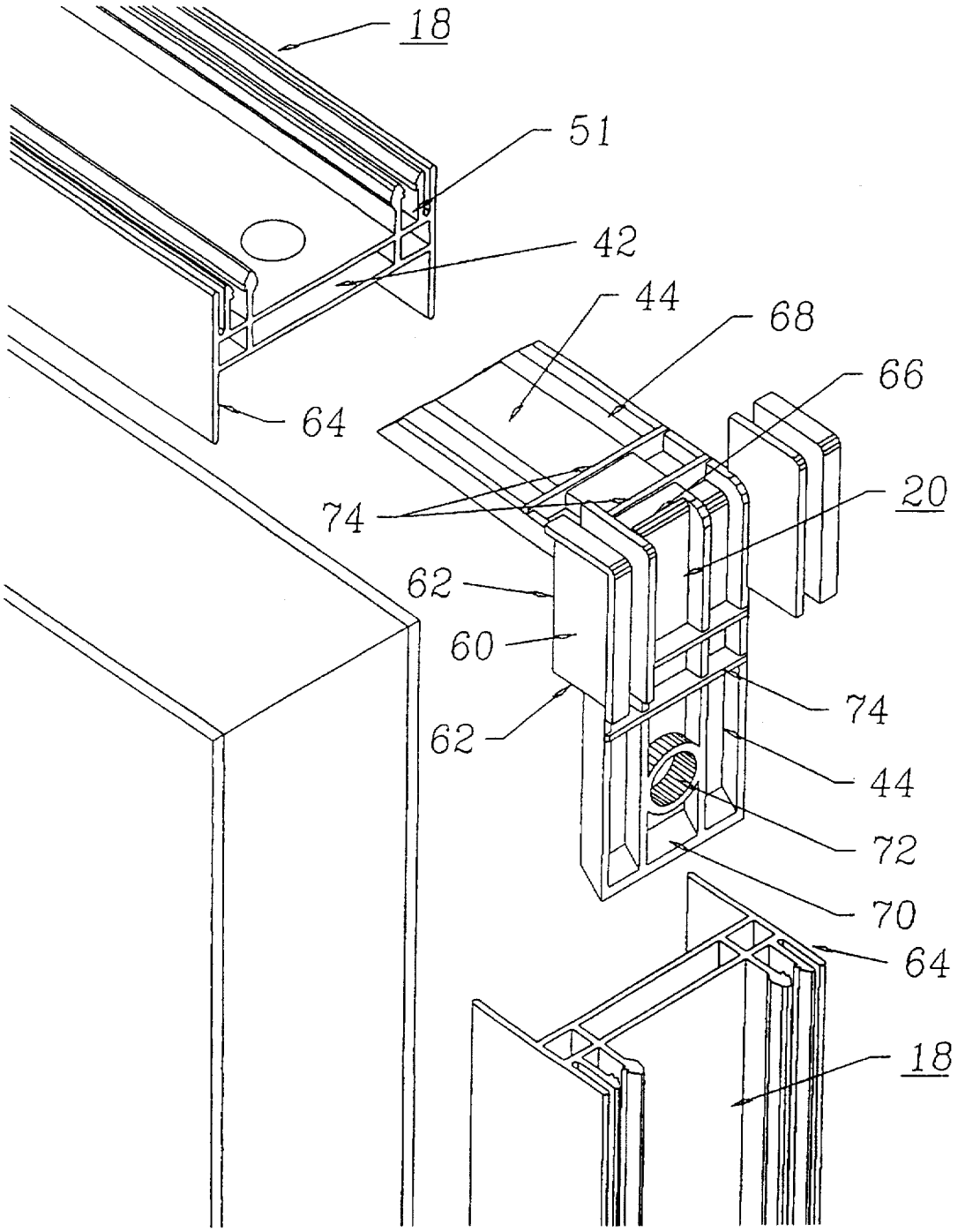
FIG. 3 is a further exploded view showing the details of one form of corner connector.
Figure 4:
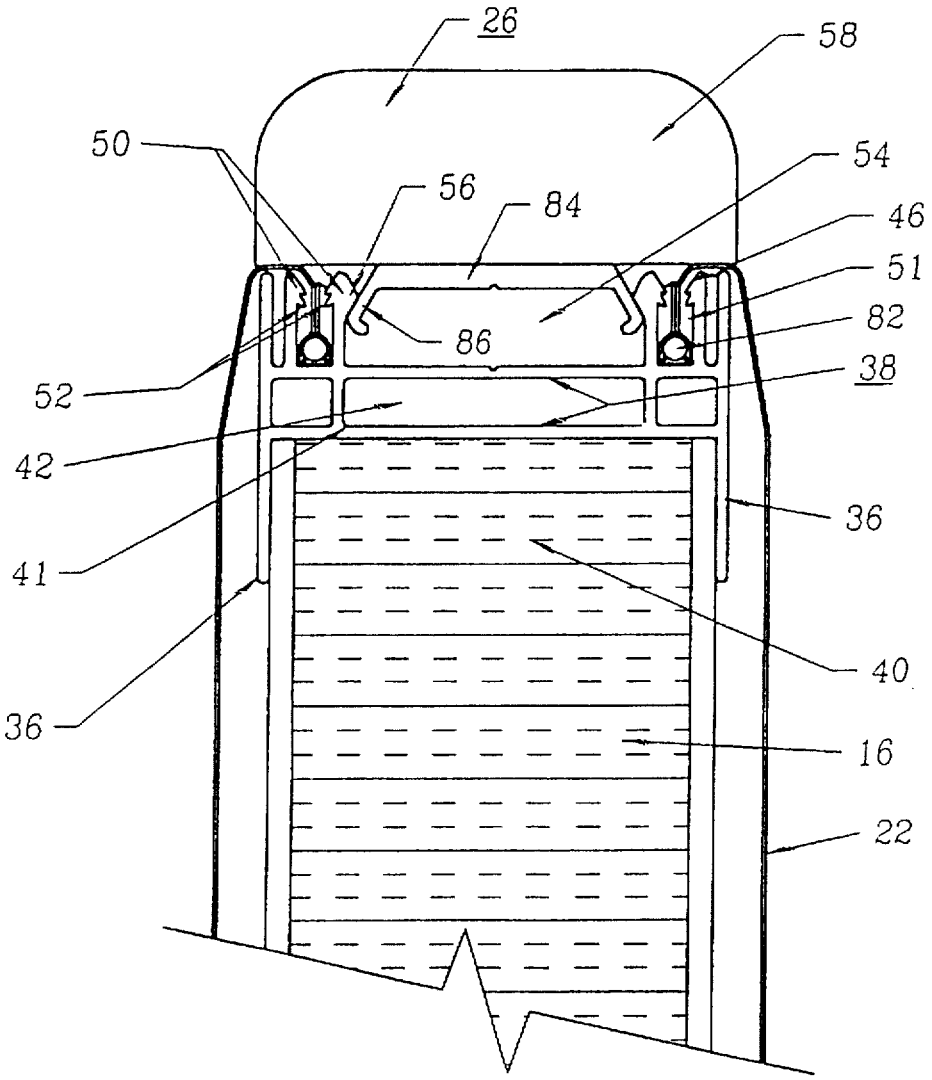
FIG. 4 is a cross-section view of one portion of a panel showing a panel edge trim cover in snap-fitting engagement with a perimeter frame member.

With reference particularly to FIGS. 2, 3 and 4, the perimeter frame members 18 comprise extruded members of uniform cross-section along their lengths preferably made from a synthetic plastics material such as rigid polyvinyl chloride (PVC). Each frame member includes a spaced apart pair of generally parallel primary flanges 36 and a double-walled web 38 extending between and fixed to the primary flanges 36 generally at right angles thereto to define a primary channel 40 extending along one wall 41 of the web 38, which primary channel 40 receives therein a marginal edge portion of the panel core 16. The double-walled web 38 serves to define a lengthwise extending hollow cavity 42 adapted to receive a leg 44 of an associated corner connector 20 for joining adjacent frame members 18 together at the corners of the panel assembly. A spaced apart pair of groove-defining elements 46 extend along opposing longitudinal marginal portions of the double-walled web 38 with each of these elements 46 being adjacent a respective one of the primary flanges 36 but disposed on that wall 43 of the web 38 which is opposite to said one wall 41 referred to above. These groove-defining elements 46 are in the form of spaced pairs 48 of secondary flanges 50 which are generally parallel to the primary flanges 36. The secondary flanges 50 have retaining means thereon to assist in securing marginal edge portions of the panel covering fabric 22, 24 therein in the form of tooth-like projections 52 formed on the interior distal end portions of the secondary flanges 50 and directed into the interior or mouth portions of the grooves 51 to provide a re-entrant shape to the latter for retention of the panel covering therein as will be described hereinafter.

It will also be noted that the secondary flanges 50 have a shallow U-shape secondary channel 54 defined therebetween, the secondary channel being defined by an inner pair of the secondary flanges 50 as well as said opposite wall 43 of the web. Each of the inner pair of secondary flanges 50 has enlargements 56 which are inwardly directed toward each other and extending along the free distal edges thereof. Their purpose is to secure a panel edge trim cover 58 in snap-fitting engagement with the secondary flanges as will be described hereinafter.

In the assembled condition of the partition panel the above-described frame members 18 extend along the top, bottom and vertical side edges of the panel core 16 with the marginal edges of the panel core being received within the primary channels 40 of the several frame members, with the primary flanges 36 thereof disposed in flanking relation to edge portions of the core 16 and snugly embracing the same. As a result of this overlap of the primary flanges 36 of the perimeter frame members 18 with the composite structural core 16, sufficient rigidity is maintained within the panel structure as to resist point loads applied to the perimeter frame 14, i.e. these point loads tend to be distributed more evenly to the core 16.

As noted previously, the perimeter frame members 18 are secured firmly together at the four corners of the panel assembly 12 by means of corner connectors 20, one being disposed at each corner of the assembly. Each corner connector 20 includes a pair of legs 44 at right angles to each other, each leg fitting tightly into the adjacent ends of the frame members 18 by way of the hollow cavities 42 described previously thereby to secure the frame members 18 together at the corners of the panel assembly.

Referring to the corner connector 20 as seen in FIG. 3 for example it has, as noted previously, a pair of legs 44 extending at 90° angles to one another away from a central body 60. The central body has opposing pairs of shoulders 62 formed thereon also at right angles to each other and which shoulders butt up against the adjacent ends 64 of the frame members 18 in the assembled condition. It should also be noted that this central body 60 of the corner connector has formations 66 thereon defining spaced apart grooves 68 which are arranged so as to communicate with and be generally co-planar with the above-described grooves 51 in the frame members 18 thereby to enable the marginal edges of the covering fabric 22, 24 to be engaged and held in the grooves 51 all around the perimeter of the panel assembly including its corners. It should be noted however that the grooves 68 in the corner connectors 20 do not include the aforementioned re-entrant shape nor any form of projections as described previously in connection with the frame members.

Insofar as the two legs 44 of the corner connector are concerned, each leg has one surface of generally continuous flattened shape while the other surface is formed to define a plurality of stiffening ribs 70. A hole 72 is formed in one of these legs through which a fastener may be inserted. Such fasteners are typically used to secure the above-mentioned feet members 30 to the panel assembly 12 either at the partition panel corners or in a line of partitions interconnected together. Each corner connector leg 44 tapers slightly from the central portion out to the distal end thereof to facilitate insertion of the legs 44 into the adjacent perimeter frame members 18 while at the same time the dimensions are carefully selected as to require a light force fit therebetween to ensure that these components are all snugly and securely connected together. To enhance this secure connection between the perimeter frame members 18 and the corner connector 20, transverse ribs 74 are provided on each leg adjacent the central portions thereof. These ribs 74 act so as to ensure an interference fit between the corner connector legs 44 and the interior walls 41, 43 of the frame members 18 and in fact serve to provide a type of interference fit. When fully assembled with the ends 64 of the perimeter frame members 18 abutting against the shoulders 62 of the central portion 60 of the corner connector 20, the corner connectors serve to further enhance the structural rigidity of the overall assembly.

Figure 3A:
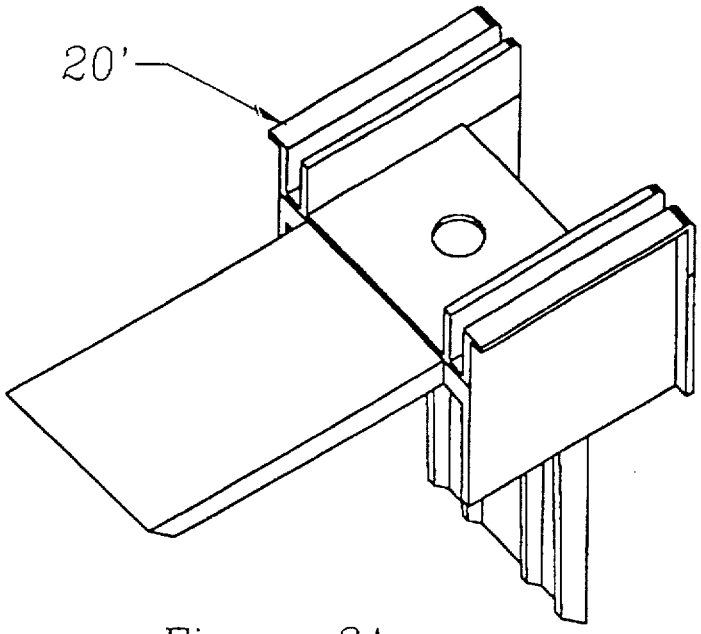
FIGS. 3A and 3B are perspective views of a modified form of corner connector usable in a manner very similar to that illustrated in FIG. 3.
Figure 3B:
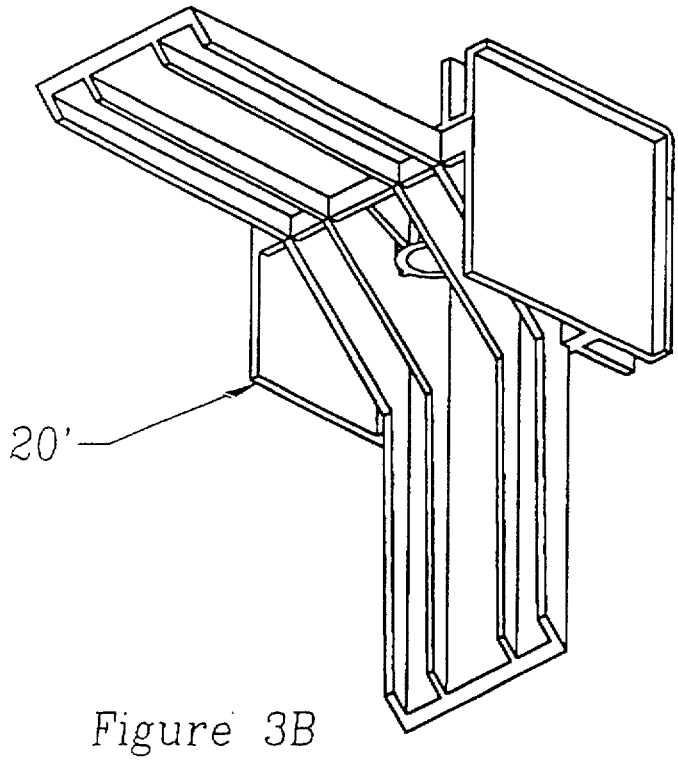

A slightly modified form of corner connector 20' is illustrated in FIGS. 3A and 3B. However, the overall principle of operation is essentially the same as that described previously.

Figure 5:
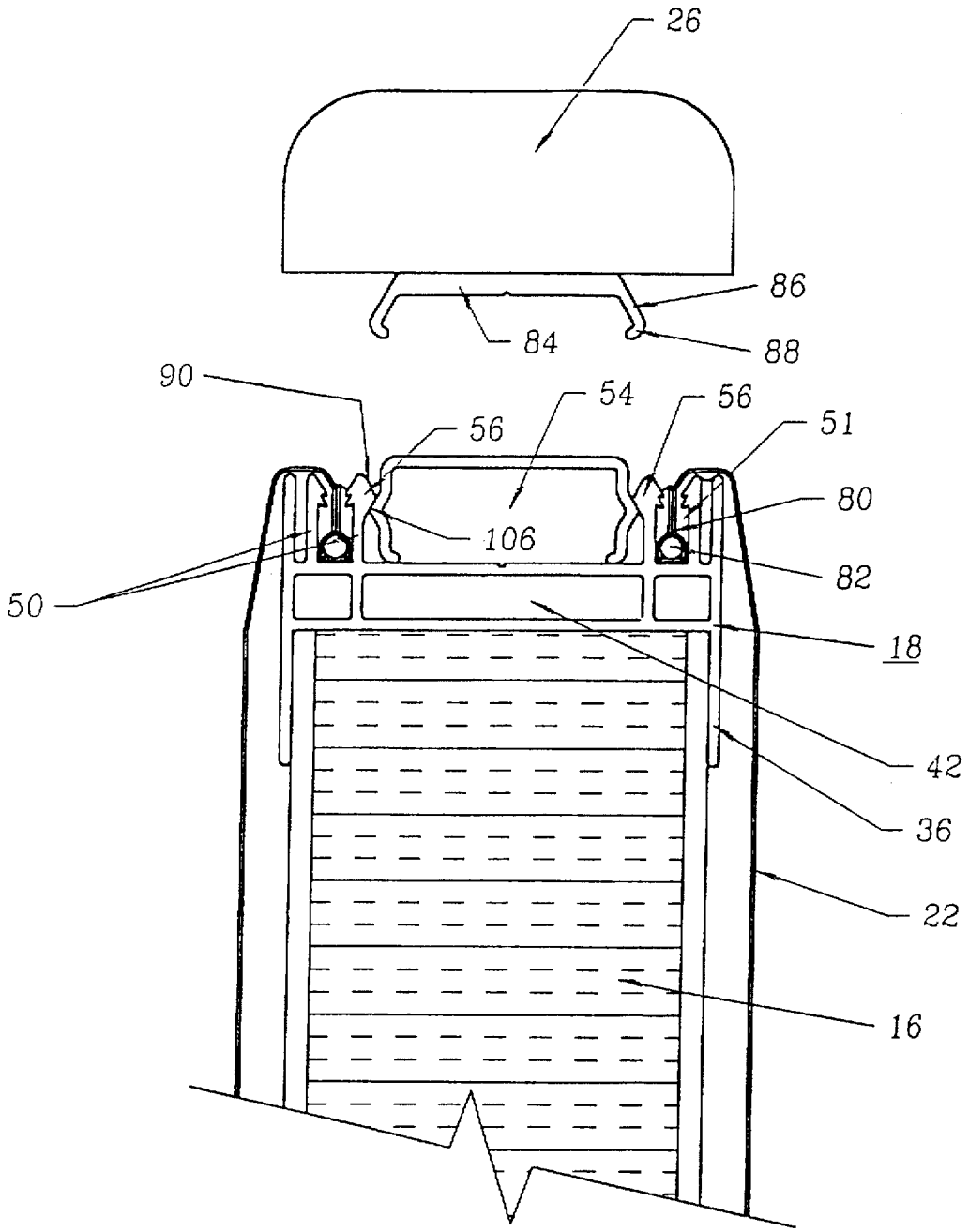
FIG. 5 is a view similar to FIG. 4 but showing the trim cover member removed from the panel assembly and with one portion of a panel connector disposed in snap-fitting engagement with a perimeter frame member.

With further reference to FIG. 4 as well as FIG. 5, it will be seen that the marginal edge portions 80 of the covering fabric are disposed within the grooves 51, 68 of the frame members 18 and corner members 20 to thereby snugly secure the covering material 22, 24 in overlying relation to the major faces of the panel assembly 12. In order to provide secure retention of the covering fabric, the marginal edges 80 of same have an enlargement or bead 82 extending therealong which becomes firmly entrapped in the above-mentioned grooves and is held there by way of friction and the aforementioned tooth-like projections 52 which are formed on the interior mouth portions of the grooves to provide the aforementioned re-entrant shape.

It was previously noted that the secondary flanges provide a shallow U-shape secondary channel 54 therebetween which faces outwardly of the panel assembly 12. It was also noted that each of the inner pair of secondary flanges 50 has inwardly directed enlargements 56 along the free distal edges of same. As best seen in FIGS. 4 and 5, there is provided a trim cover 26 which is adapted to come into snap-fitting engagement with these enlargements 56 of the secondary flanges. The trim covers 26 are made sufficiently long as to extend substantially the full lengths of the associated top and side edges of the panel assembly 12 thereby to cover up the underlying perimeter frame members 18. The exposed trim covers 26 may be made of wood if desired of have any suitably attractive finish or it may be a composite fabric covered item or made of plastics material as desired. In order to secure this trim cover 26 in snap-fit relationship to the inner pair of secondary flanges 50 as described above, the underside of each trim cover is provided with a shallow channel-shaped clip 84 extending lengthwise thereof and including downwardly and outwardly extending leg portions 86 having inturned marginal edges 88 which serve to engage the slightly sloped surfaces 90 at the inner distal ends of the inner pair of secondary flanges, which leg portions 86 and secondary flanges 50 are then deflected sufficiently as to allow the clip to snap-fit into the position illustrated in FIG. 4 with the leg portions of the clip 86 firmly engaged behind the enlargements 56 of the secondary flanges, with the clip 86 at the same time exerting laterally outwardly directed forces on these inner secondary flanges 50 thus tending to close somewhat the mouth portions of the aforementioned grooves 51 thus firmly retaining the enlargement or bead portions 82 at the marginal edges of the covering fabric 22 (together with any underlying layer of material) firmly in place.

The overall process for the assembly or manufacture of the partition panel assembly described above is illustrated generally in FIGS. 6A–6F. As shown in FIG. 6A, the plastic extrusions are cut to length to form perimeter frame members 18 of the desired length. It will be noted that the saw cuts are made at right angles to the lengthwise dimension of the extrusion. Next, the material for the composite structural core 16 is cut to size (FIG. 6B). It might be mentioned here that the core 16 is typically of a paperboard "honeycomb" construction to provide sound dampening etc. This type of core is well known per se and generally comprises a cellular "honeycomb" interior with the individual cells running transversely to the major surfaces of the core, such major surfaces being of sturdy paperboard sheets adhesively bonded to the interior honeycomb structure.

As shown in FIG. 6C, the perimeter frame members 18 are assembled around the perimeter of the core with the frame members snugly embracing the marginal edge portions of the core 16 and, in the process of this assembly, the legs of the corner connectors 20 are inserted into the opposing ends of the respective frame members such that during assembly of the frame members 18 and the corner connectors 20 become firmly secured to the associated frame members 18 thereby to hold the entire assembly together.

As illustrated in FIG. 6D, any desired holes in the frame members are then drilled following which metal inserts are installed as required thereby to provide for attachment of the feet and any other desired hardware to the plastic frame members.

As illustrated in FIG. 6E, the fabric cover material (together with an underlying foam layer 24 if desired) is applied to the major surfaces of the panel assembly 12 and the marginal edges together with the bead or spline 82 are inserted into the aforementioned grooves provided in the frame members and corner connectors by way of a roller tool (well known per se in the art) thereby to firmly secure the covering materials to the panel assembly.

With reference to FIG. 6, the final assembly procedure involves installing the feet members 30 using suitable fasteners to co-operate with inserts which have been installed previously and following this the several trim covers 26, 28 are snap fitted into place along the side and top edges of the panel assembly 12 thereby to complete the same.

Figure 7:
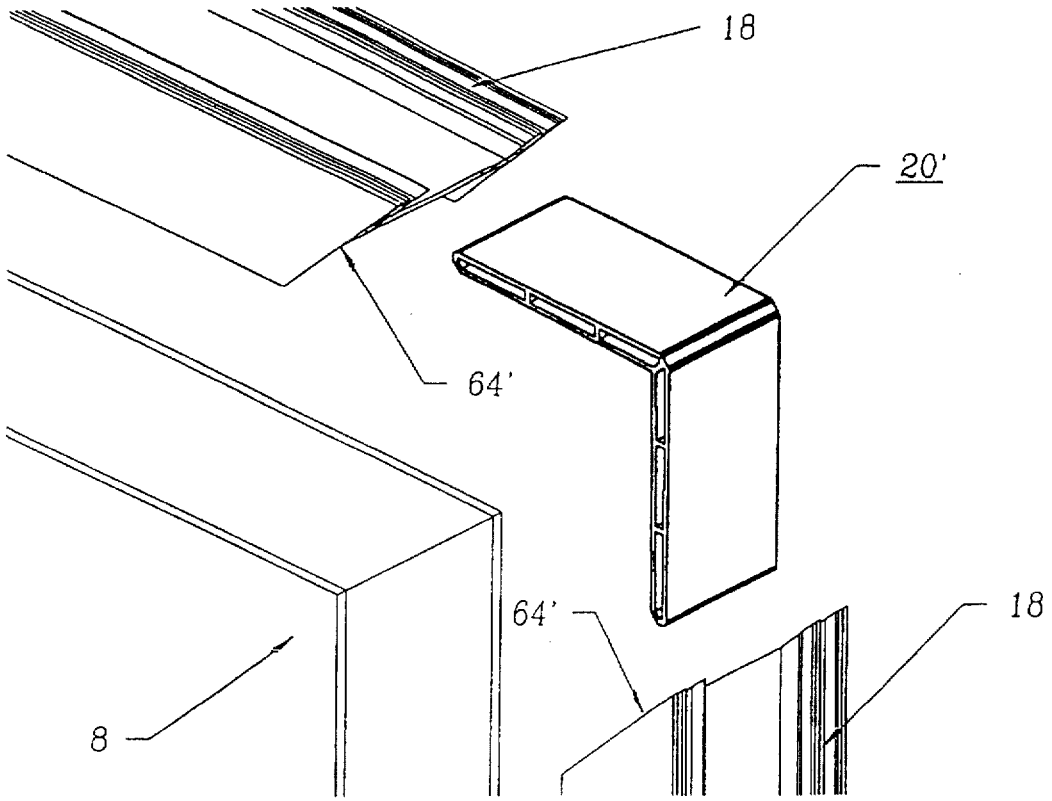
FIG. 7 is a further exploded view somewhat similar to FIG. 3 but illustrating a different form of corner connector.
Figure 8:
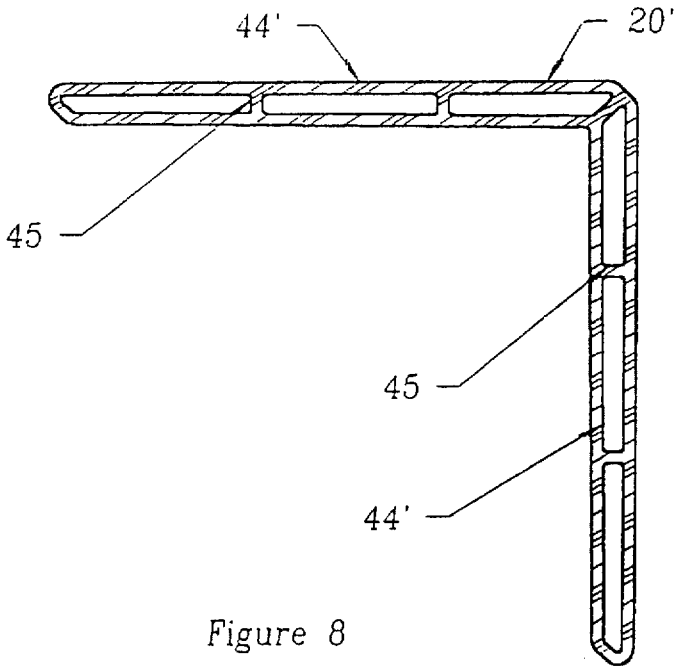
FIG. 8 is a side elevation view illustrating the corner connector utilized in FIG. 7.

A modified form of corner connection arrangement is illustrated in FIGS. 7 and 8. In this arrangement the perimeter frame members 18 are formed exactly as described previously except that the adjacent ends 64' of the perimeter frame members when assembled butt up against each other with these adjacent ends 64' being angled or bevelled at 45° to provide a complementary fit. In this condition, the modified corner connector 20' is fully enclosed by the adjacent end portions of the frame members 18, i.e. it does not have shoulders or grooves in its central portion as with the corner connector 20 previously described.

The modified corner connector 20' is clearly illustrated in FIG. 8. It comprises a simple extrusion of plastics material in an L-shape with the two legs 41' being at right angles to one another. The opposing surfaces of the legs are angled so that there is a slight downward taper therein toward the distal ends of same thereby to provide the light force-fit engagement within the previously described lengthwise extending cavities 42 provided by the perimeter frame members 18. The legs 44' of the modified corner connector are mainly hollow as illustrated in FIG. 8 but have short transverse webs 45 at spaced intervals. These webs prevent excessive deformation of the legs when inserted and when considering the deformation which occurs in the cavity defining portions of the perimeter frame member 18, tends to ensure firm relatively slip-free engagement.

The manufacturing/assembly process for the modified corner arrangement of FIGS. 6 and 7 is depicted in FIGS. 9A–9F. Referring to FIG. 9A, the extrusion is cut to length to form individual perimeter frame members it being noted particularly that the cuts are made at a 45° angle to the lengthwise dimension to provide the bevelled ends 64' as shown in FIG. 7. Following this, the core is cut to size as shown in FIG. 9B; then the frame members are assembled together around the perimeter of the core as shown in FIG. 9C using the modified corner connectors 20' of FIGS. 7 and 8. The remaining steps as illustrated in FIGS. 9D–9F are the same as described previously in conjunction with FIGS. 6D–6F.

Figure 10:
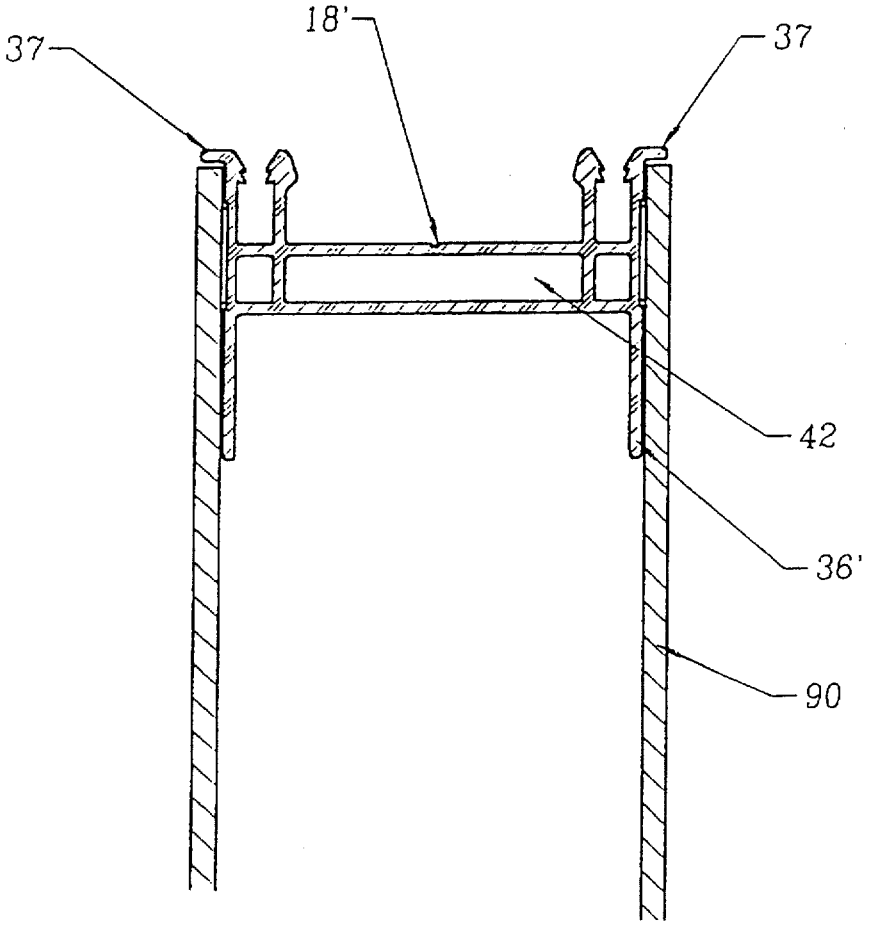
FIG. 10 is a cross-section view of a slightly modified form of perimeter frame member with portions of rigid sheet material illustrated on opposing sides thereof.

A modified perimeter frame member 18' 'is shown in cross-section in FIG. 10. This modified frame member possesses most of the features described previously, i.e. it includes the double-walled web defining the tenthwise hollow cavity 42 with the double-wailed web extending between and fixed to modified primary flanges which, as before, extend parallel to one another. The principal difference is that the modified primary flanges are each outfitted with an outwardly turned ledge 37 extending along the primary flange which is disposed adjacent the outermost peripheral edges of the assembled panel. Hence, when the frame members are assembled together in a rectangular configuration using the desired corner connectors, these ledges 37 encompass a rectangular area within which a panel in the form of a sheet of rigid material 90 such as "Masonite" may be seated. In this form of construction the composite core is an optional feature, i.e. the composite core may be omitted altogether.

With reference to the panel manufacture/assembly process using the modified frame members 18', FIG. 11A again shows the extrusion being cut to length to form individual modified frame members 18' and these frame members are then assembled as in FIG. 11C into a rectangular outline frame (possibly with one or more transverse frame members 19 as desired) using the corner connectors 20' shown previously in FIGS. 7 and 8. The panels 90, such as "Masonite" are then cut to size as shown in FIG. 11B and then such panels are placed on opposing sides of the frame construction previously assembled such that the ledges 37 defined by the modified frame members 18' encompass and surround the opposing panels to hold them in place.

Referring to FIG. 11E, the edge of cover fabric 22 is then rolled into place as described previously in connection with FIG. 6E, thus retaining the opposing panels firmly in place on the perimeter frame following which the trim strips 26,28 and feet are installed as before with reference to FIG. 11F.

Referring now to FIGS. 12 through 21, there are shown multiple embodiments of a snap-in panel-to-panel connector 96. Partition panels 10 can be removably connected together by snapping the connector 96 into the perimeter frame secondary channels 54 at the end of each panel of equal height, which connecting device is then secured with a fastener to the perimeter frame member. Two, three or four panels may be interconnected together by choosing the appropriate connecting device. Each of the several embodiments as shown is in two parts connected together by a pivot pin which enables the several panels to be positioned adjacent to each other at various subtended angles.

Figure 12:
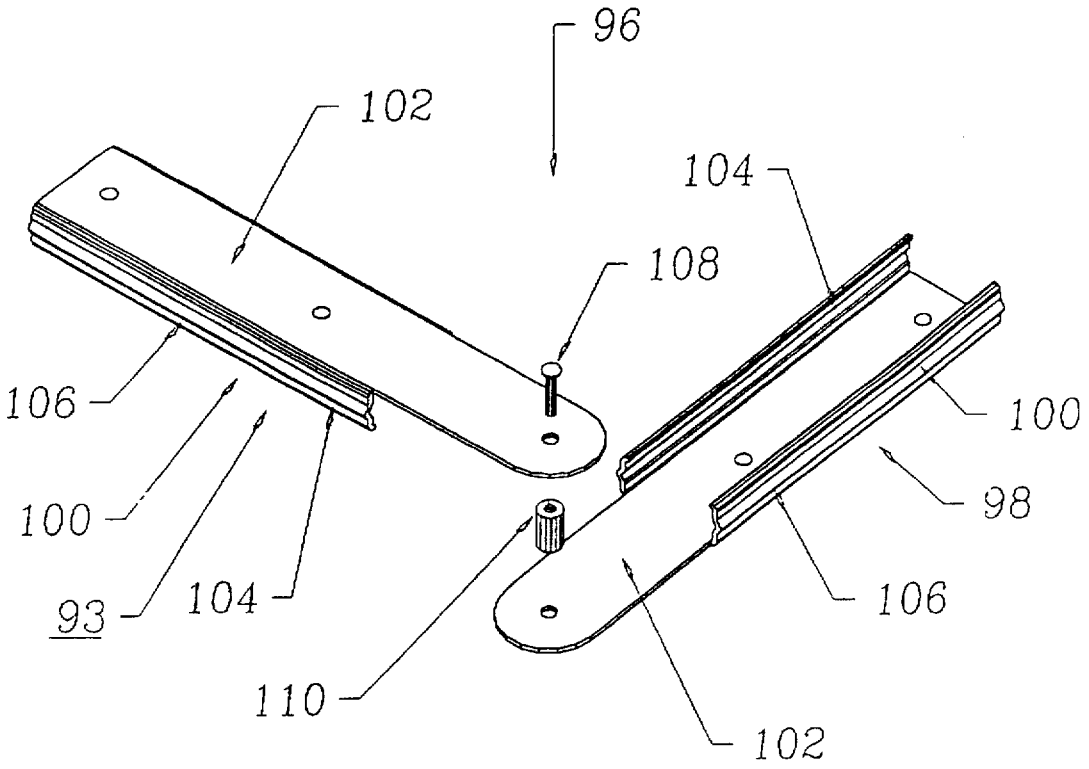
FIG. 12 is an exploded perspective view of one embodiment of panel-to-panel snap-in connector.

Referring firstly to FIGS. 5 and 12, the panel-to-panel connector is, as noted above, for use with panels of substantially equal height each having at least a horizontal top frame member which provides a spaced pair of parallel flanges 50 defining a secondary channel 54 with the flanges having protrusions 56 thereon directed inwardly toward each other as illustrated in FIG. 5. As shown in FIG. 12, the connector includes a pair of members 98 pivotally connected together, each such member including at least one retainer clip 100 adapted to be snap-fitted into engagement with the protrusions 56 of the flanges 50 which form the channel 54 of the associated panel frame member 12. The retainer clips 100 are also slidably adjustable along their associated channels 54 before being fixed in place by fasteners thereby to permit a variety of angular orientations of the panels relative to one another as noted above.

As seen in FIG. 12 and in the remaining FIGS. 13–21, each member includes an elongated flat tongue 102 with the retainer clip or clips for each member being formed at distal end portions of the respective tongues 102 with the tongues of the members being pivotally connected together at a point spaced from the retainer clips.

As seen in FIGS. 5 and 12, each retainer clip 100 comprises a shallow channel-shaped formation defined by a spaced apart pair of walls 104 on opposing sides of the distal end portion of the tongue. These walls each have a projection 106 formed therein which as shown is of a generally shallow lengthwise extending V-shaped configuration which is adapted to complement and come into the snap-fit engagement with the protrusions 56 on the aforementioned flanges of the panel frame members.

In the embodiment of FIG. 12, the two connector members 98 are pivotally connected by a pivot pin 108 with the adjacent ends of the tongues 102 of these members being held in slightly spaced apart relation by a spacer sleeve 110. In this particular embodiment, one retainer clip in effect faces downwardly, i.e. its opposing walls 104 are directed downwardly when fitted into position while the other is in the opposite orientation with its retainer clip facing upwardly.

Figure 12A:
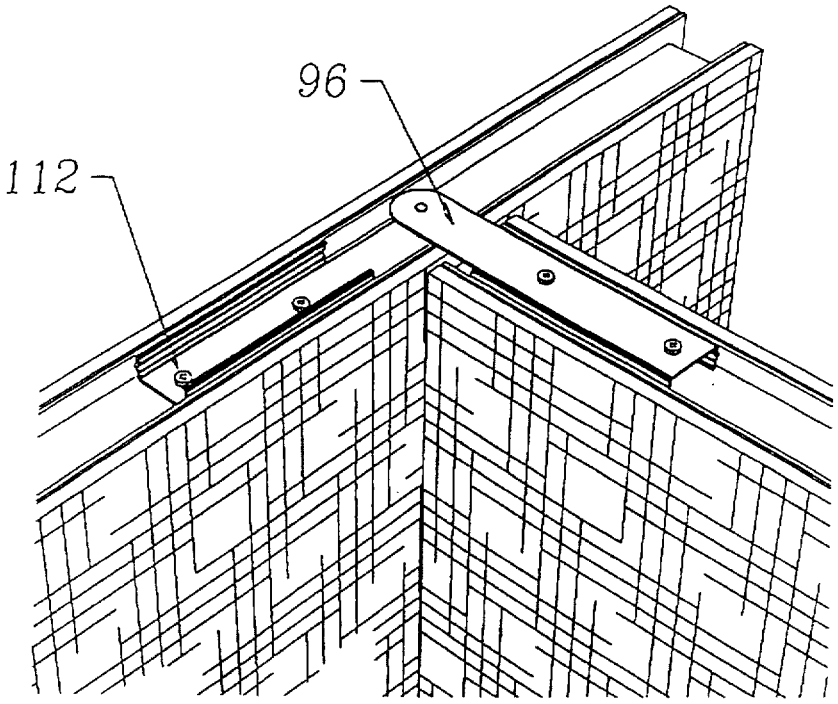
FIGS. 12A and 13 show differing ways of utilizing the two way connector of FIG. 12.
Figure 13:
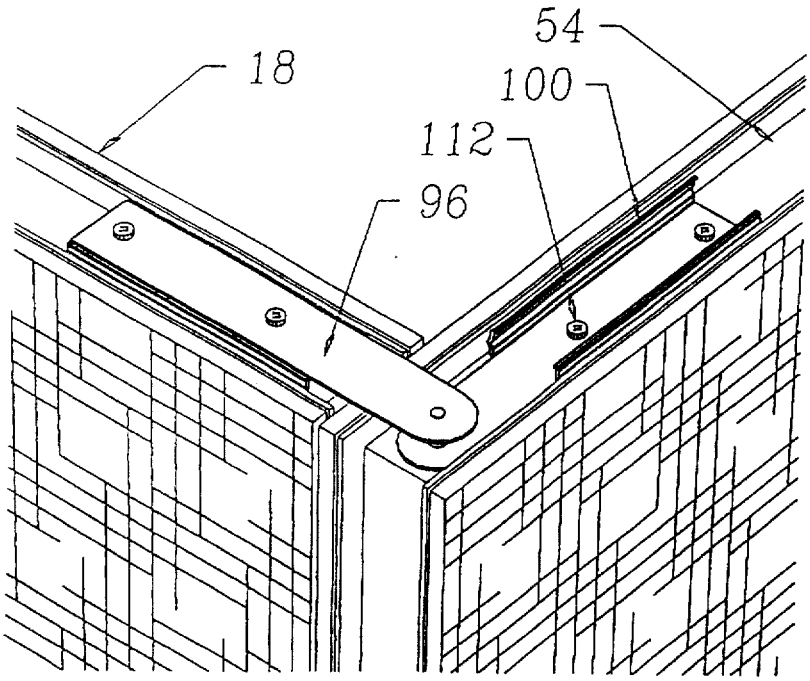

FIGS. 12A and 13 show slightly differing applications of the embodiment of FIG. 12; in both cases the panels 10 are secured at right angles to one another although other orientations are of course possible. In both cases it will be noted that the retainer clips 100 are restrained against sliding movement along the associated channels 54 of the panel frame members 18 by suitable fasteners 112.

Figure 14:
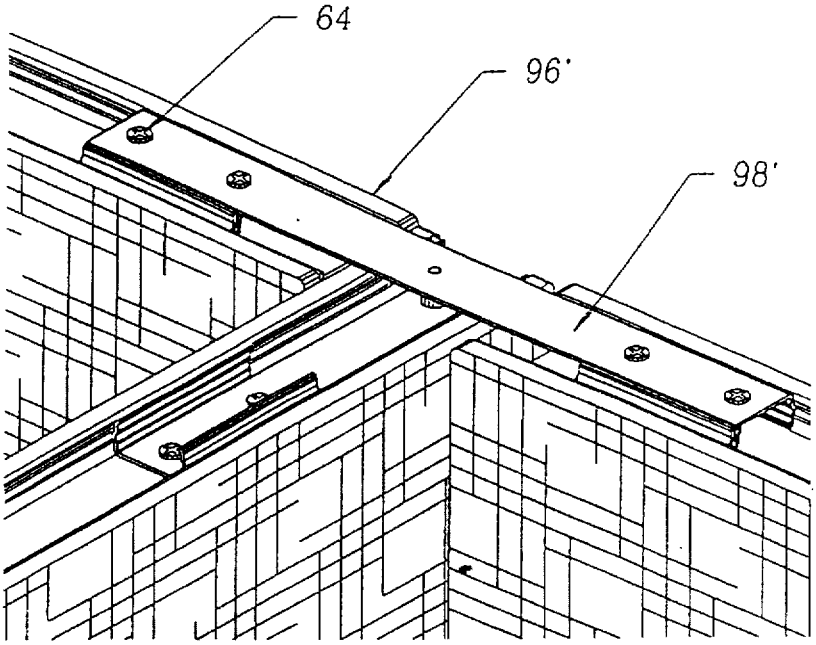
FIGS. 14 and 15 show modified three-way and four-way panel-to-panel connectors.

FIG. 14 shows a modified panel-to-panel connector 96' where a first connector member 98' employs two retainer clips 100, each located at distal end portions of the elongated tongue 102'.

Figure 15:
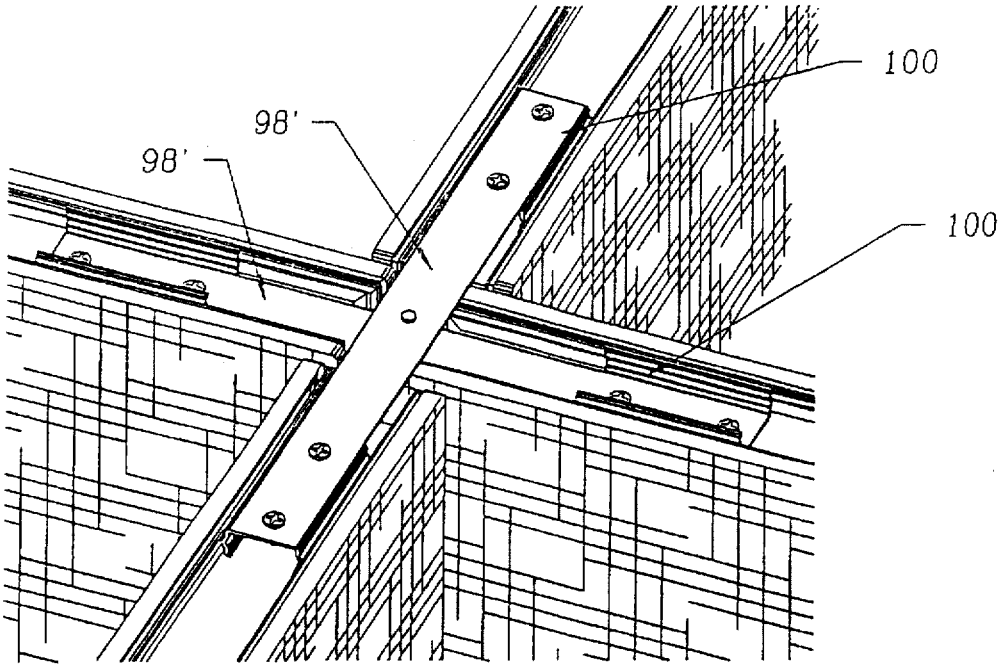

In the four-way embodiment of FIG. 15 the two connector members 98" are each provided with two retainer clips 100 such retainer clips, as before, being located at distal end portions of the associated members with the central tongue portions 102' being connected together by the central pivot pin 108 but held in spaced apart relation by the spacer sleeve 110 noted previously.

FIGS. 16, 17 and 18 show slightly modified forms of panel-to-panel connectors. The two-way connector of FIG. 16 corresponds essentially to that of FIGS. 12–13 except that the tongues 102 of the two members 98 are directly secured together by means of the pivot pin 108, i.e. the spacer sleeve has been omitted. The same applies to the three-way connector of FIG. 17 and the four-way connector of FIG. 18.

The manner of use of the two-way connector of FIG. 16 is illustrated in FIGS. 19A, B and C. As before, the retainer clips of the respective members are snap-fitted into the channels of the associated panel frame members 18 but it will be seen from these FIGS. 19A–C that the retainer clips for both members face downwardly. As before, once they have been adjusted to the desired position or positions along the channels of the panel frame members, they are secured in position by suitable fasteners. The same holds true for the three-way and four-way connectors of FIGS. 20 and 21 wherein it will be seen that the connector members are oriented with the retainer clips facing downwardly with the connector members being secured in position by suitable fasteners.

Preferred embodiments of the invention have been described and illustrated by way of example. Those skilled in the art will realize that various modifications and changes may be made while still remaining within the spirit and scope of the invention. Hence the invention is not to be limited to the embodiments as described but, rather, the invention encompasses the full range of equivalencies as defined by the appended claims.

We claim:

1. A partition panel including a generally rectangular core having opposed major faces, a plurality of corners and a plurality of marginal edges, and a perimeter frame assembly encompassing said core, said perimeter frame assembly comprising a plurality of frame members extending along said marginal edges of the core, and a plurality of corner connectors each located at a respective one of the corners of the core and attaching adjacent ends of said frame members together, said frame members including spaced primary flanges directed generally parallel to said major faces and disposed in flanking relation to marginal edge portions of said core, and said frame members each further including a double-walled web extending between said primary flanges and providing a lengthwise extending hollow cavity, each corner connector including a pair of legs each fitting tightly into respective adjacent ends of the frame members via the associated hollow cavities to secure said frame members together at said corners of the core of the panel and, wherein said frame members include spaced apart groove defining members each of which is adjacent a respective one of said primary flanges and adjacent opposing longitudinal margins of said web with the grooves defined thereby being directed outwardly of the perimeter of the panel, and a flexible covering material overlying the major faces of said core and having marginal edges of said material engaged in said grooves to secure said covering material in overlying relation to said major faces.

2. The partition panel of claim 1 wherein said groove-defining members are in the form of secondary flanges parallel to said primary flanges, said secondary flanges having retaining means thereon to secure the marginal edges of the covering material therein.

3. The partition panel of claim 2 wherein said retaining means comprise projections formed on interior or mouth portions of said grooves to provide a re-entrant shape to said grooves, said marginal edges of the covering materials having enlargements or beads therealong entrapped in said grooves via said projections.

4. The partition panel of claim 2 wherein said secondary flanges have a shallow U-shape channel therebetween, said channel being defined by said secondary flanges and an outwardly facing wall of said web, said channel also facing outwardly away from the perimeter of the panel, each of said secondary flanges having enlargements along free distal edges thereof, and panel edge trim covers in snap-fitting engagement with said enlargements of the secondary flanges to cover at least one of said perimeter frame members.

5. The partition panel of claim 1 wherein each said corner connector has formations thereon defining spaced-apart grooves communicating with and generally co-planar with said grooves in said frame members whereby the marginal edges of said covering material are engaged and held in said grooves all around the perimeter of the panel including its corners.

6. The partition panel of claim 5 wherein each said corner connector has shoulders thereon which butt-up against respective adjacent ends of the perimeter frame members when the legs of the corner connectors are fully inserted into said hollow cavities of said frame members, said legs being in a close friction fit within said cavities.

7. The partition panel of claim 6 wherein said perimeter frame members and said corner connector have an outstanding perimeter ledge thereon which receive and surround a sheet of rigid material positioned over each of the major faces of the core.

8. The partition panel of claim 1 wherein the adjacent ends of the perimeter frame members butt-up against each other, said adjacent ends being angled or bevelled to provide a complementary fit, and said corner connector being fully enclosed by adjacent end portions of the frame members when butted-up against one another in the assembled condition.

9. The partition panel of claim 1 wherein said frame members comprise plastics extrusions of uniform cross-section throughout their lengths.

10. A perimeter frame member adapted to be located at the perimeter of a partition panel, said frame member having a spaced apart pair of generally parallel primary flanges and a double-walled web extending between and fixed to said primary flanges generally at right angles thereto to define a primary channel along one wall of said web and said double-walled web providing a lengthwise-extending hollow cavity adapted to receive a leg of a corner connector for joining adjacent said frame members together; and a spaced apart pair of groove defining elements extending along opposing longitudinal marginal portions of said web with each being adjacent a respective one of said primary flanges but disposed on that wall of the web opposite said one wall, said groove defining elements including secondary flanges generally parallel to said primary flanges, said secondary flanges having retaining means thereon adapted, in use, to assist in securing a marginal edge of a panel covering material therein.

11. The perimeter frame member of claim 10 wherein said retaining means comprise projections formed on said secondary flanges and directed into interior or mouth portions of said grooves to provide a re-entrant shape to the latter for retention of a marginal edge portion of a covering material.

12. The perimeter frame member of claim 11 wherein said secondary flanges have a shallow U-shape secondary channel therebetween, said secondary channel being defined by said secondary flanges and said opposite wall of said web, said secondary flanges having enlargements inwardly directed toward each other along free distal edges thereof adapted to secure a panel edge trim cover in snap-fitting engagement with the perimeter frame member.

13. The perimeter frame member of claim 10 being an extrusion of plastics material.

14. A partition panel of generally rectangular outline having opposed major faces, a plurality of marginal edges and a plurality of corners, and a perimeter frame assembly comprising a plurality of frame members extending along the marginal edges of the panel, and a plurality of corner connectors each located at a respective one of the corners of the panel and attaching adjacent ends of said frame members together, said frame members including spaced primary flanges directed generally parallel to said major faces, said frame members each further including a double-walled web extending between said primary flanges and providing a lengthwise extending hollow cavity, each corner connector including a pair of legs each fitting tightly into adjacent ends of the frame members via the associated hollow cavities to secure said frame members together at said corners of the panel, and wherein said frame members include spaced apart groove defining members each of which is adjacent a respective one of said flanges and adjacent opposing longitudinal margins of said web and the grooves defined thereby being directed outwardly of said panel marginal edges, and a flexible covering material overlying said major faces and having marginal edges of said material engaged in said grooves to secure said covering material in overlying relation to said major faces of the panel.

15. The partition panel of claim 14 wherein said groove-defining members comprise spaced pairs of secondary flanges parallel to said primary flanges, said secondary flanges having retaining means thereon securing the marginal edges of the covering material therein.

16. The partition panel of claim 15 wherein said retaining means comprise projections formed on interior or mouth portions of said grooves to provide a re-entrant shape to the grooves, said marginal edges of the covering materials having enlargements or beads therealong entrapped in said grooves via said projections.

17. The partition panel of claim 15 wherein said secondary flanges have a shallow U-shape channel therebetween, said channel being defined by an inner pair of said secondary flanges and an outwardly facing wall of said web, said channel also facing outwardly away from the perimeter of the panel, each of said inner pair of secondary flanges having enlargements along free distal edges thereof, and panel edge trim covers in snap-fitting engagement with said enlargements of the secondary flanges to cover at least one of said perimeter frame members.

18. The partition panel of claim 14 wherein said perimeter frame members and said corner connectors have outstanding perimeter ledges on opposing sides thereof which receive and surround respective sheets of rigid material positioned to define each of the major faces of the panel.

19. The partition panel of claim 18 wherein the adjacent ends of the perimeter frame members butt-up against each other, said adjacent ends being angled or bevelled to provide a complementary fit, and said corner connector being fully enclosed by adjacent end portions of the frame members when butted-up against one another in.

20. The partition panel of claim 15 wherein said frame members comprise plastics extrusions of uniform cross-section throughout their lengths.

* * * * *